US005657979A

United States Patent [19]

Bruce et al.

[11] Patent Number: 5,657,979

[45] Date of Patent: Aug. 19, 1997

[54] COLLATOR AND METHOD FOR CONTROLLING THE COLLATOR

[75] Inventors: Andrew D. Bruce, Troy; Horng J. Yang, Westerville; James D. Johnstone, West Carlton; Aaron J. Belvo, Miamisburg; Darryl W. Coy, Springboro, all of Ohio

[73] Assignee: Heidelberg Finishing Systems, Inc., Dayton, Ohio

[21] Appl. No.: 589,866

[22] Filed: Jan. 23, 1996

Related U.S. Application Data

[63] Continuation of Ser. No. 237,611, May 3, 1994, abandoned.

[51] Int. Cl.[6] ..... B65H 39/02

[52] U.S. Cl. ..... 270/58.01; 270/58.2

[58] Field of Search ..... 270/58.01, 58.2, 270/58.21, 58.22

[56] References Cited

U.S. PATENT DOCUMENTS

| | | |
|---|---|---|
| 3,809,385 | 5/1974 | Rana . |
| 3,917,252 | 11/1975 | Harder et al. . |
| 4,022,455 | 5/1977 | Newsome et al. . |
| 4,121,818 | 10/1978 | Riley et al. . |
| 4,768,766 | 9/1988 | Berger et al. . |
| 4,789,147 | 12/1988 | Berger et al. . |
| 5,028,192 | 7/1991 | Lindsay et al. . |
| 5,039,075 | 8/1991 | Mayer . |
| 5,316,281 | 5/1994 | Bale et al. . |
| 5,346,196 | 9/1994 | Nussbaum et al. . |
| 5,413,321 | 5/1995 | Bank et al. . |

*Primary Examiner*—John T. Kwon

*Attorney, Agent, or Firm*—Tarolli, Sundheim, Covell, Tummino & Szabo

[57] ABSTRACT

A collator comprises a first hopper for storing signatures having a first characteristic and a second hopper for storing signatures having a second characteristic. A plurality of collating pockets move relative to the first and second hoppers and receive signatures from the first and second hoppers. An actuatable feeder, when actuated, feeds an individual signature from one of the first and second hoppers. A memory stores a predetermined number corresponding to the number of individual signatures to be delivered from the first hopper. The feeder is controlled to initially feed individual signatures from the first hopper to the plurality of pockets until the number of individual signatures delivered equals the predetermined number and then to feed individual signatures from the second hopper to the plurality of pockets without stopping movement of the pockets relative to the first and second hoppers.

6 Claims, 6 Drawing Sheets

COLLATOR AND METHOD FOR CONTROLLING THE COLLATOR

This application is a Continuation application of application Ser. No. 08/237,611, Filed on May 3, 1994, now abandoned.

BACKGROUND OF THE INVENTION

1. Technical Field

The present invention relates to a collator, and is particularly directed to a method for controlling a collator so that the collator need not stop during a changeover from one job to the next job.

2. Background Art

Collators for producing magazines or the like, referred to herein as "books", are known to handle a number of different jobs. For example, one job may be collating a sequence of books to be delivered to a certain zip code and another job may be collating a sequence of books to be delivered to a different zip code. Other jobs may include collating books for newsstand sale, collating a sequence of books to be directed to and inspected by an operator for their quality, or collating a sequence of books which is a reorder of books previously made and subsequently rejected.

The sequencing of books produced for a particular job is typically determined from a tape containing an address list corresponding to the particular job. When the particular job is completed and the next job is to be started, the collator is stopped so that the tape corresponding to the particular job can be changed to a tape corresponding to the next job. A disadvantage results when the collator must be stopped to accommodate a job changeover because valuable production time is lost. The total production time lost can be substantial, especially if the number of job changeovers is relatively large.

SUMMARY OF THE INVENTION

In accordance with one aspect of the present invention, a collator collates magazines or the like, referred to herein as "books". The collator comprises a first hopper for storing signatures having a first characteristic and a second hopper for storing signatures having a second characteristic. A plurality of collating pockets are movable relative to the first and second hoppers and are provided for receiving signatures from the first and second hoppers. Actuatable means is provided for, when actuated, feeding an individual signature from one of the first and second hoppers. Means is provided for storing a first number corresponding to the number of individual signatures to be delivered from the first hopper. Means is provided for controlling actuation of the actuatable means to initially feed individual signatures from the first hopper to the plurality of pockets until the number of individual signatures delivered equals the first number and then to feed individual signatures from the second hopper to the plurality of pockets without stopping movement of the pockets relative to the first and second hoppers.

In accordance with another aspect of the present invention, a collator collates a first sequence of books and then collates a second sequence of books. The collator comprises a hopper for storing signatures having a certain characteristic. A plurality of collating pockets are movable relative to the hopper and are provided for receiving signatures from the hopper. Actuatable means is provided for, when actuated, feeding an individual signature from the hopper. Means is provided for storing a first number associated with the first sequence and corresponding to the number of individual signatures to be delivered from the hopper in the first sequence and a second number associated with the second sequence and corresponding to the number of individual signatures to be delivered from the hopper in the second sequence. Means is provided for controlling actuation of the actuatable means to initially feed individual signatures from the hopper to the plurality of pockets until the number of individual signatures delivered equals the first number and then to feed individual signatures from the hopper to the plurality of pockets until the number of signatures delivered equals the second number without stopping movement of the pockets relative to the hopper.

In accordance with still another aspect of the present invention, a collator comprises a first hopper for storing signatures having a first characteristic, and a second hopper for storing signatures having a second characteristic. A plurality of collating pockets are movable relative to the first and second hoppers and are provided for receiving signatures from the first and second hoppers. Actuatable means is provided for, when actuated, feeding an individual signature from one of the first and second hoppers. Means is provided for controlling actuation of the actuatable means to initially feed individual signatures from the first hopper to the plurality of pockets. Means is provided for (i) enabling interruption of the feeding of individual signatures from the first hopper to the plurality of pockets, and (ii) controlling actuation of the actuatable means to feed individual signatures from the second hopper to the plurality of pockets without stopping movement of the pockets relative to the first and second hoppers after feeding of individual signatures from the first hopper to the plurality of pockets has been interrupted.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF PREFERRED EMBODIMENT

The present invention is directed to a collator and a method for controlling the collator so that the collator need not stop during a changeover from one job to the next job. A job is a sequence of one or more magazines or the like of the same type to be produced. The magazines or the like are referred to herein as "books". The present invention may be used in collators of different constructions. The description below is merely representative of the present invention as applied to a flatback, or saddle binding line and newspaper inserters.

Figure 1:
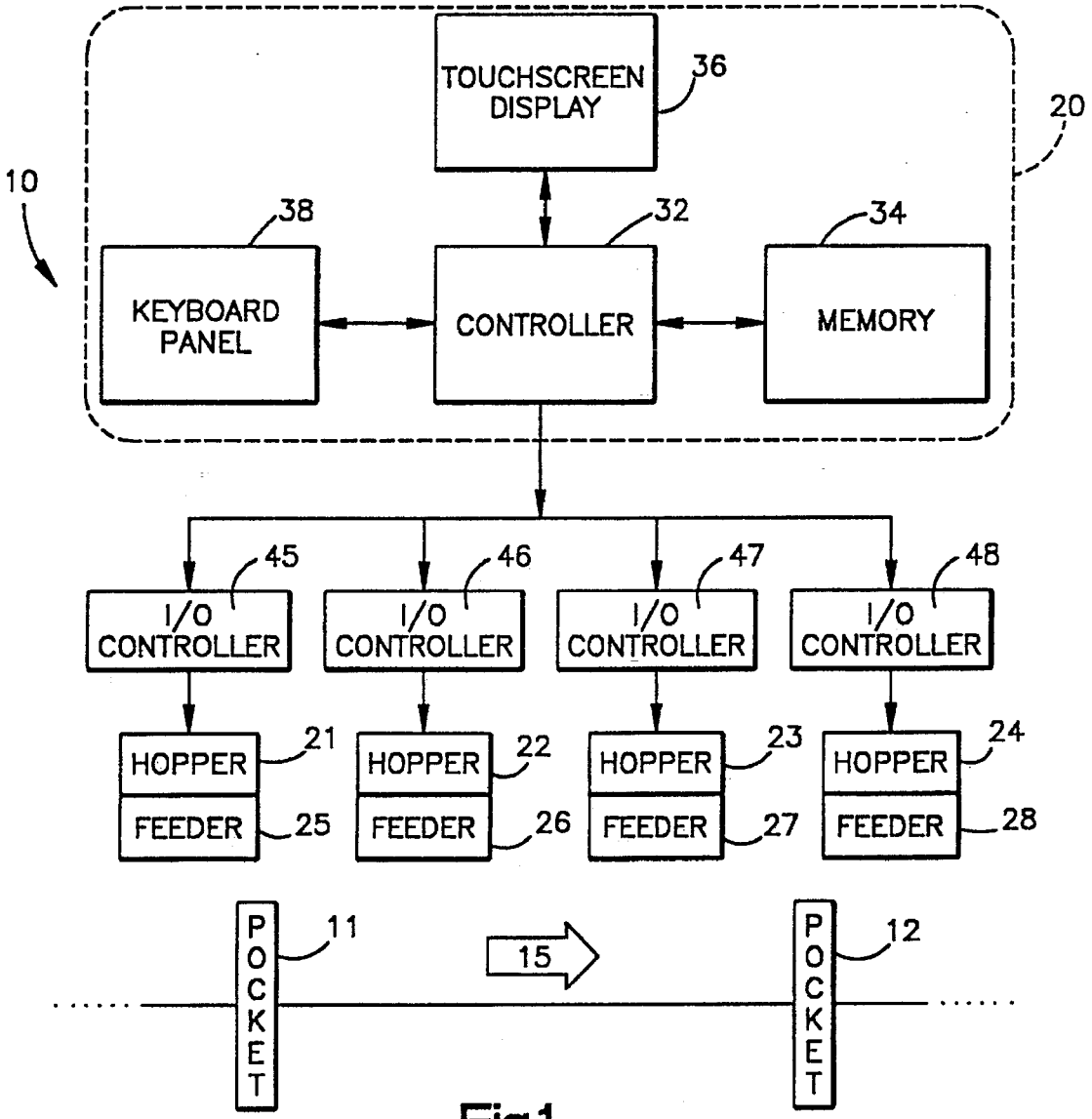
FIG. 1 is a schematic block diagram of a collator constructed in accordance with the present invention.

By way of example, the present invention is illustrated in FIG. 1 as embodied in a collator 10 having four hoppers 21, 22, 23, 24 and four feeding mechanisms 25, 26, 27, 28 associated with the four hoppers 21, 22, 23, 24, respectively. The feeding mechanisms 25, 26, 27, 28 are conventional in the art and, therefore, are not described. The actual number of hoppers and associated feeding mechanisms can be any number. However, for purposes of explanation only, four hoppers and four associated feeding mechanisms are illustrated in FIG. 1. Each of the hoppers 21, 22, 23, 24 stores signatures having a characteristic associated with a geographic region or demographic feature.

Four I/O controllers 45, 46, 47, 48 are associated with the four feeding mechanisms 25, 26, 27, 28, respectively. Each I/O controller controls operation of its associated feeding mechanism and thereby to control operation of the associated hopper. The structure and operation of the I/O controllers are known and, therefore, are not described.

The collator 10 also includes a plurality of collating pockets of which only two pockets 11, 12 are illustrated in FIG. 1. Each of the pockets 11, 12 is movable in a direction of the arrow 15 underneath the four hoppers 21, 22, 23, 24 to receive signatures from the hoppers. The collator 10 is controlled to produce sequences of books.

The collator 10 also has a control console 20. The control console 20 includes a controller 32 which communicates via a high speed serial network, such as ETHERNET, with each of the four I/O controllers 45, 46, 47, 48 to control operation of the four feeding mechanisms 25, 26, 27, 28 and the four hoppers 21, 22, 23, 24 and thereby to control operation of the collator 10. The control console 20 also includes a memory 34 for storing information and data to be used by the controller 32 to control the collator 10.

The memory 34 stores information including subscription information for each individual in a mailing list. A book is collated for each individual in the mailing list. Each individual could have unique attributes that require different signatures to be fed for their book. These attributes could be based on geographic or demographic characteristics. Typically, books are produced sequentially based on geographic regions and postal carrier route order for mailing and distribution purposes. This requires the signatures in the hoppers 21, 22, 23, 24 to be fed based on the geographic or demographic characteristics of each individual which are stored as part of the subscription information. For each geographic region, a selective book for each individual in the mailing list is sequentially produced. This process of producing a book is referred to as selective binding.

The control console 20 further includes a touch screen display 36 electrically connected with the controller 32. The controller 32 and the touch screen display 36 cooperate to provide a number of menus and/or graphic illustrations associated with different parts of the collator 10. The touch screen display 36 is an input device and provides an operator-actuated control for controlling operation of the collator 10 including selection of the types of jobs to be run, the number of jobs to be run, and the order in which the selected jobs are to be run. The display 36 allows the controller 32 to display information to the operator and permits an easy way for the operator to enter information to the controller 32 by simply touching the display screen in appropriate locations prompted by the system software program. Such touch screen displays are well known in the art and will not be described in detail herein.

The control console 20 further includes a keyboard panel 38 electrically connected with the controller 32. The keyboard panel 38 is another input device for enabling the operator to control operation of the collator 10. The keyboard panel 38 has a number of pressable keys electrically connected with the controller 32 to provide another way of entering information to the controller 32.

Figure 2:
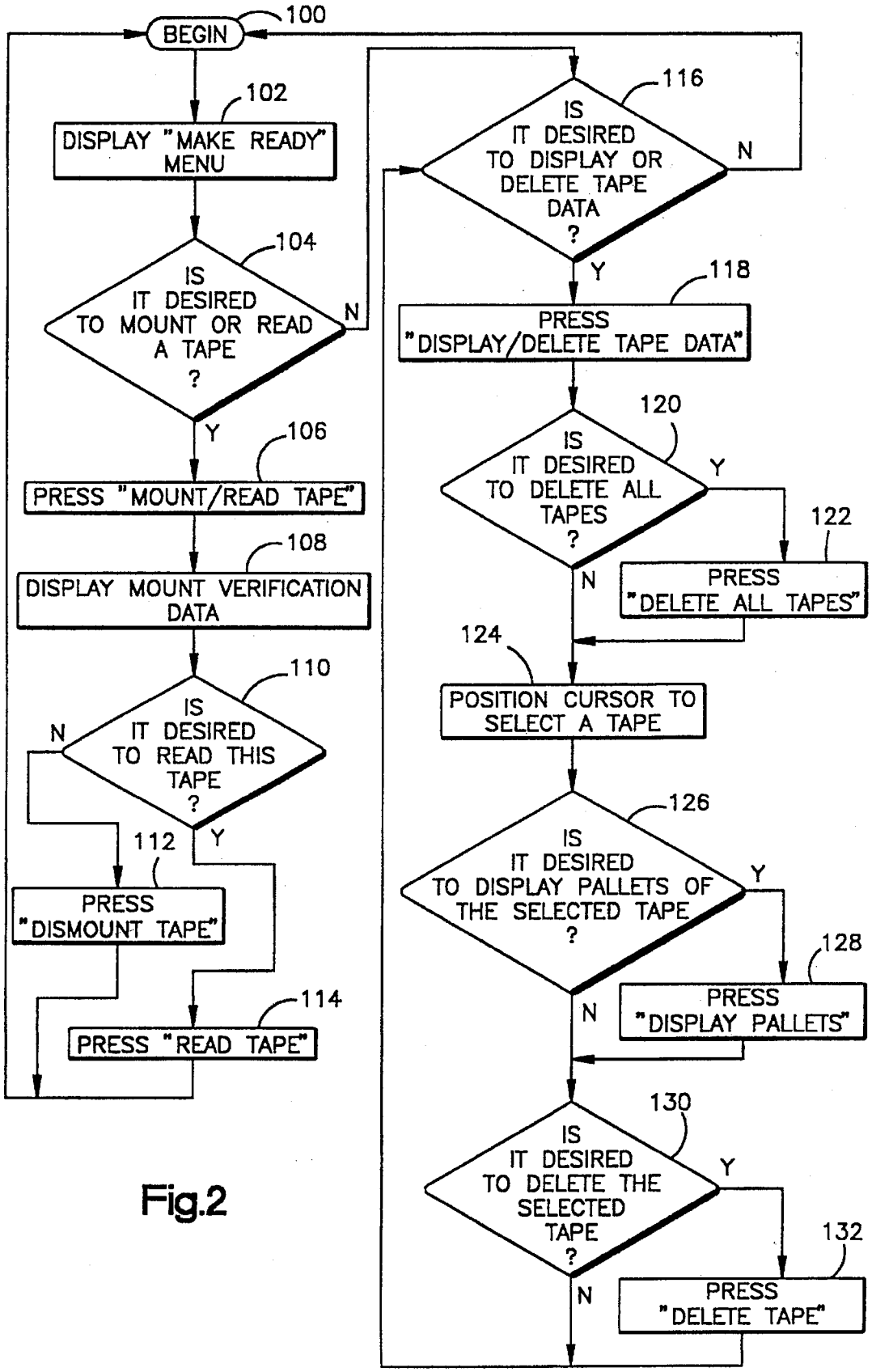
FIGS. 2–8 are flow charts depicting operation of the collator of FIG. 1 in accordance with the present invention.

Referring to FIG. 2, the flow chart depicts the process followed by an operator for loading, reading, and deleting tapes which may be run on the collator 10. The program begins in step 100 and proceeds to step 102 in which a make-ready menu is displayed on the touch screen display 36. In this menu, a number of touch responsive areas with labels appear on the touch screen display 36. In step 104, the determination is made by the operator as to whether is desired to mount or read a tape. If the determination in step 104 is negative, the program proceeds to step 116. If the determination in step 104 is affirmative, the program proceeds to step 106 in which the operator manually mounts a tape and then presses a touch responsive area labelled "MOUNT/READ TAPE" which appears on the touch screen display 36. When the touch responsive area labelled "MOUNT/READ TAPE" is pressed, as shown in step 106, verification data associated with the mounted tape is displayed on the touch screen display 36, as shown in step 108, to allow the operator to verify the displayed data.

The program then proceeds to step 110 in which a determination is made by the operator as to whether to read the mounted tape. If the determination in step 110 is affirmative, the operator presses a touch responsive area labelled "READ TAPE", as shown in step 114. The program then returns to the beginning in step 100. If the determination in step 110 is negative, the operator presses a touch responsive area labelled "DISMOUNT TAPE", as shown in step 112, and then manually dismounts the mounted tape. The program then returns to the beginning in step 100.

As previously stated, if the determination in step 104 is negative, i.e., the operator decides to neither mount nor read a tape, the program proceeds to step 116. In step 116, a determination is made by the operator as to whether it is desired to display or delete certain tape data. If the determination in step 116 is negative, the program returns to the beginning in step 100. If the determination in step 116 is affirmative, the program proceeds to step 118 in which the operator presses a touch responsive area labelled "DISPLAY/DELETE TAPE DATA".

The program then proceeds to step 120 in which a determination is made by the operator as to whether it is desired to delete all tapes. If the determination in step 120 is affirmative, the program proceeds to step 122 in which the operator presses a touch responsive area labelled "DELETE ALL TAPES" to delete all tapes. The program then proceeds to step 124. If the determination in step 120 is negative, the program proceeds directly to step 124. In step 124, the operator positions the cursor which appears on the touch screen display 36 to select a particular tape.

The program then proceeds to step 126 in which a determination is made by the operator as to whether it is desired to display pallets of the selected tape from step 124. If the determination in step 126 is affirmative, the program proceeds to step 128 in which the operator presses the touch responsive area labelled "DISPLAY PALLETS". The program then proceeds to step 130. If the determination in step 126 is negative, the program proceeds directly to step 130.

In step 130, a determination is made by the operator as to whether it is desired to delete the selected tape of step 124. If the determination in step 130 is affirmative, the program proceeds to step 132 in which the operator presses a touch responsive area labelled "DELETE TAPE" to delete the selected tape. The program then returns to step 116. If the determination in step 130 is negative, the program directly returns to step 116.

Referring to FIGS. 3–8, the flow charts depict the process followed by the operator for selecting the types of jobs to be run on the collator 10, the number of jobs to be run, and the sequence in which the selected jobs are to be run. The program begins in step 200 (FIG. 3A) and proceeds to step 202 in which a job control queue menu is displayed on the touch screen display 36. In step 204, a determination is made by the operator as to whether it is desired to delete a job which appears on the touch screen display 36. If the determination in step 204 is negative, the program proceeds directly to step 210. If the determination in step 204 is affirmative, the program proceeds to step 206 in which the operator positions the cursor which appears on the touch screen display 36 to point to the desired job to be deleted. The operator then presses the touch responsive area labelled "DELETE JOB AT CURSOR", as shown in step 208, to delete the particular job.

The program then proceeds to step 210 in which a determination is made by the operator as to whether it is desired to move a job to the top of the queue. If the determination in step 210 is negative, the program proceeds directly to step 216. If the determination in step 210 is affirmative, the program proceeds to step 212 in which the operator positions the cursor which appears on the touch screen display 36 to point to the desired job to be moved to top of the queue. The operator then presses the touch responsive labelled "MOVE JOB TO TOP", as shown in step 214, to move the particular job to the top of the queue.

The program then proceeds to step 216 in which a determination is made by the operator as to whether it is desired to change the start of a job. If the determination in step 216 is negative, the program proceeds directly to step 226. If the determination in step 216 is affirmative, the program proceeds to step 218 in which the operator positions the cursor which appears on the touch screen display 36 to point to the desired job to change the start for that job. The operator then presses the touch responsive area labelled "CHANGE START" as shown in step 220.

The program then proceeds to step 222 in which a determination is made by the operator as to whether it is desired to select a particular job to be run. If the determination in step 222 is negative, the program proceeds to step 224 in which the program exits and returns to the beginning in step 220. If the determination in step 222 is affirmative, the program proceeds to step 226.

Figure 3A:
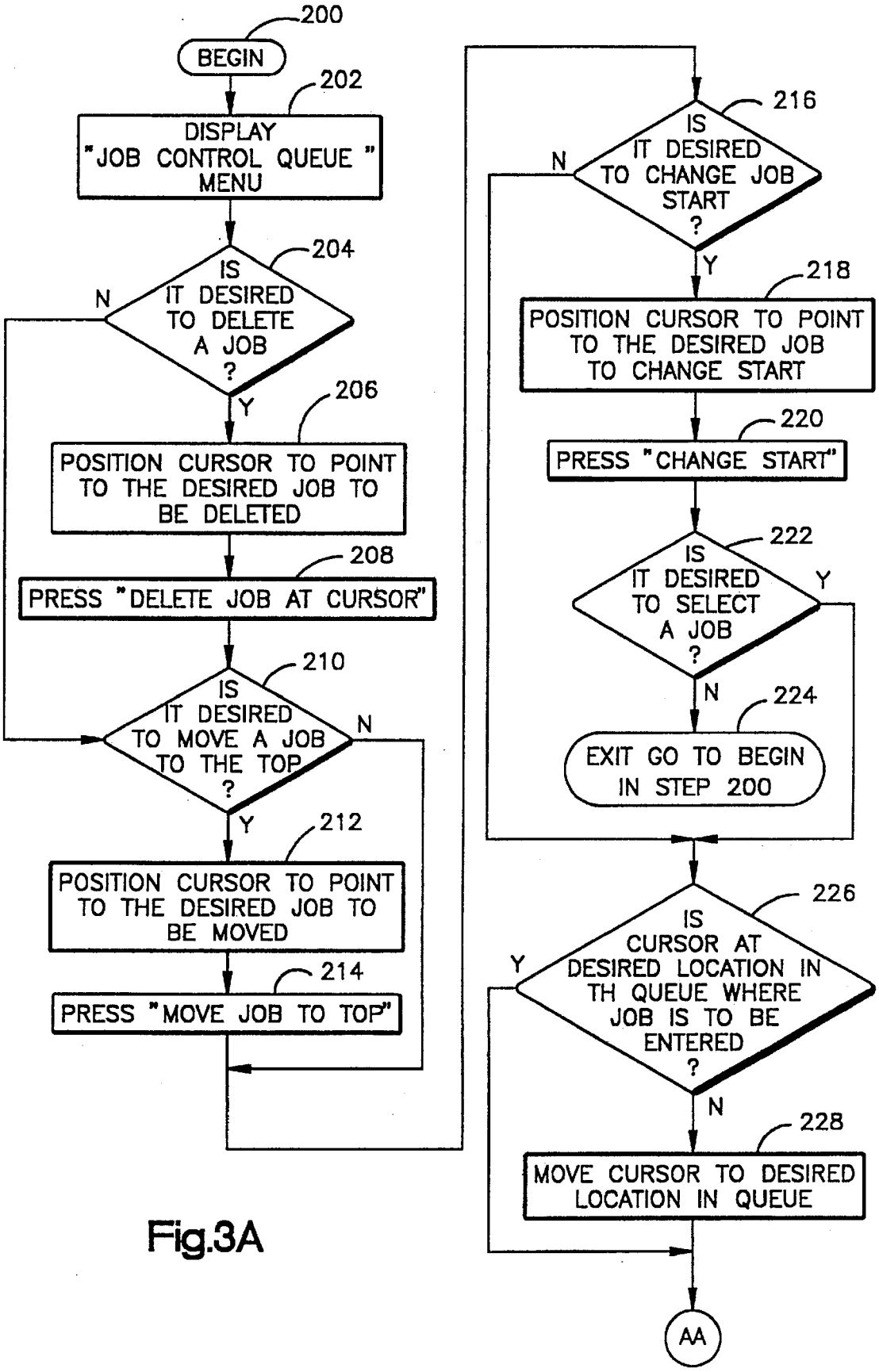
Figure 3B:
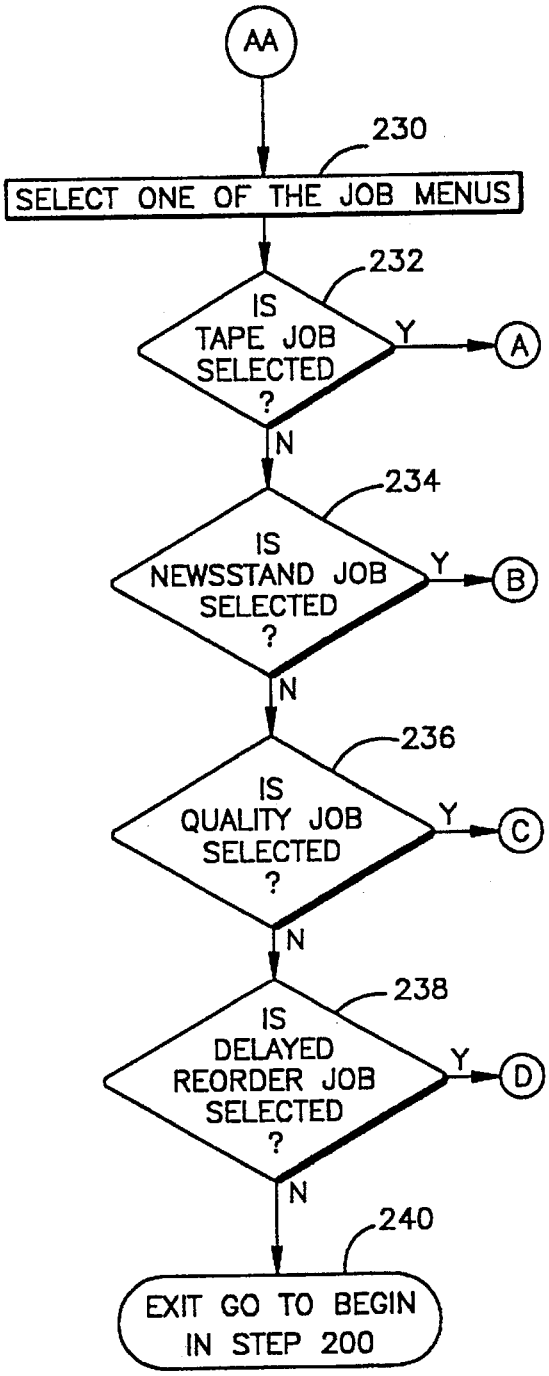
Figure 4:
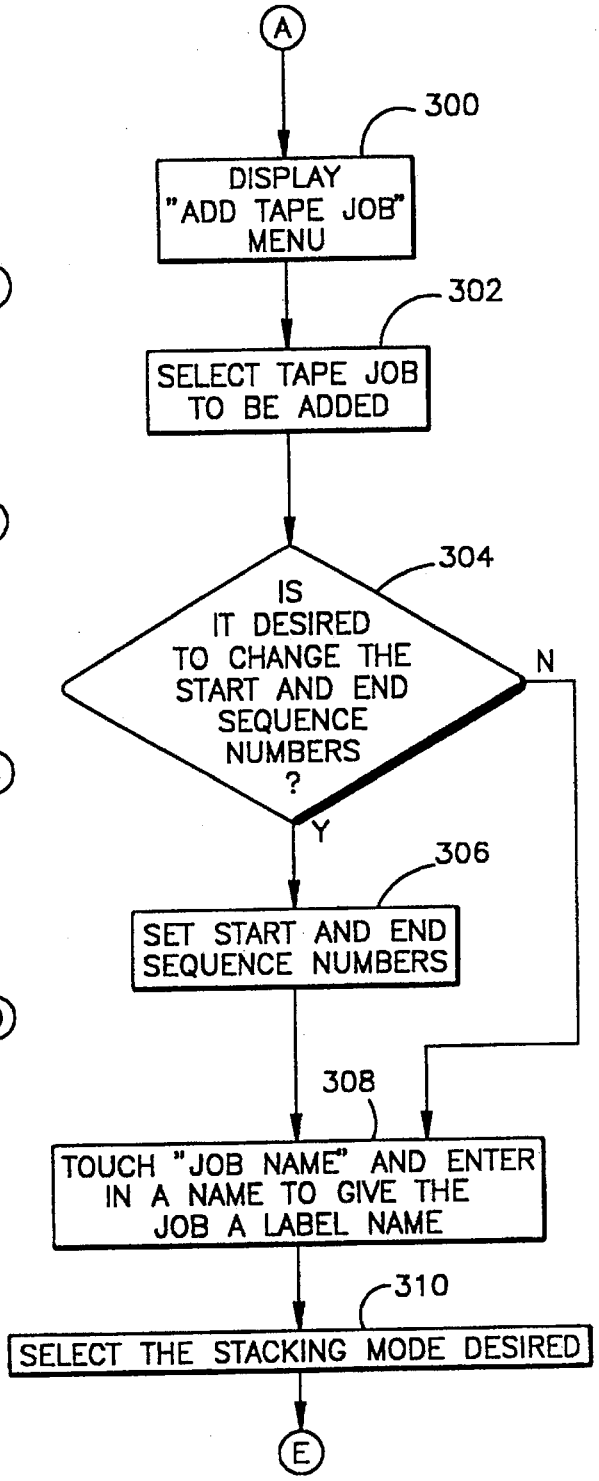

In step 226, a determination is made by the operator as to whether the cursor which appears on the touch screen display 36 is at the desired location in the queue where the particular job to be run is to be entered. If the determination in step 226 is negative, the operator moves the cursor which appears on the touch screen display 36 to the desired location in the job queue, as shown in step 228. The program then proceeds to step 230 (FIG. 3B). If the determination in step 226 is affirmative, the program proceeds directly to step 230.

In step 230, the operator selects one of the job menus. As a first example as shown in step 232, assume that two different tape jobs are to be run in which the first job is a sequence of books to be delivered to a first set of zip codes and the second job is a sequence of books to be delivered to a second set of zip codes. Some of the zip codes in each of the first and second sets of zip codes may be the same. It is possible that the zip codes in each set are either all the same or all different. When two different tape jobs are selected as determined in step 232, the program proceeds to step 300 in which an add tape job menu appears on the touch screen display 36. In step 302, the operator selects the desired tape job to be added.

The program then proceeds to step 304 in which a determination is made by the operator as to whether it is desired to change the start and end sequence numbers of the selected tape job in step 302. If the determination in step 304 is affirmative, the program proceeds to step 306 in which the operator sets the start and end sequence numbers of the selected job. The program then proceeds to step 308. If the determination in step 304 is negative, the program proceeds directly to step 308. In step 308, the operator touches a touch responsive area labelled "JOB NAME" and then enters in a name to give the selected job a label name. The program then proceeds to step 310 in which the operator selects the stacking mode desired for the selected job.

Figure 8:
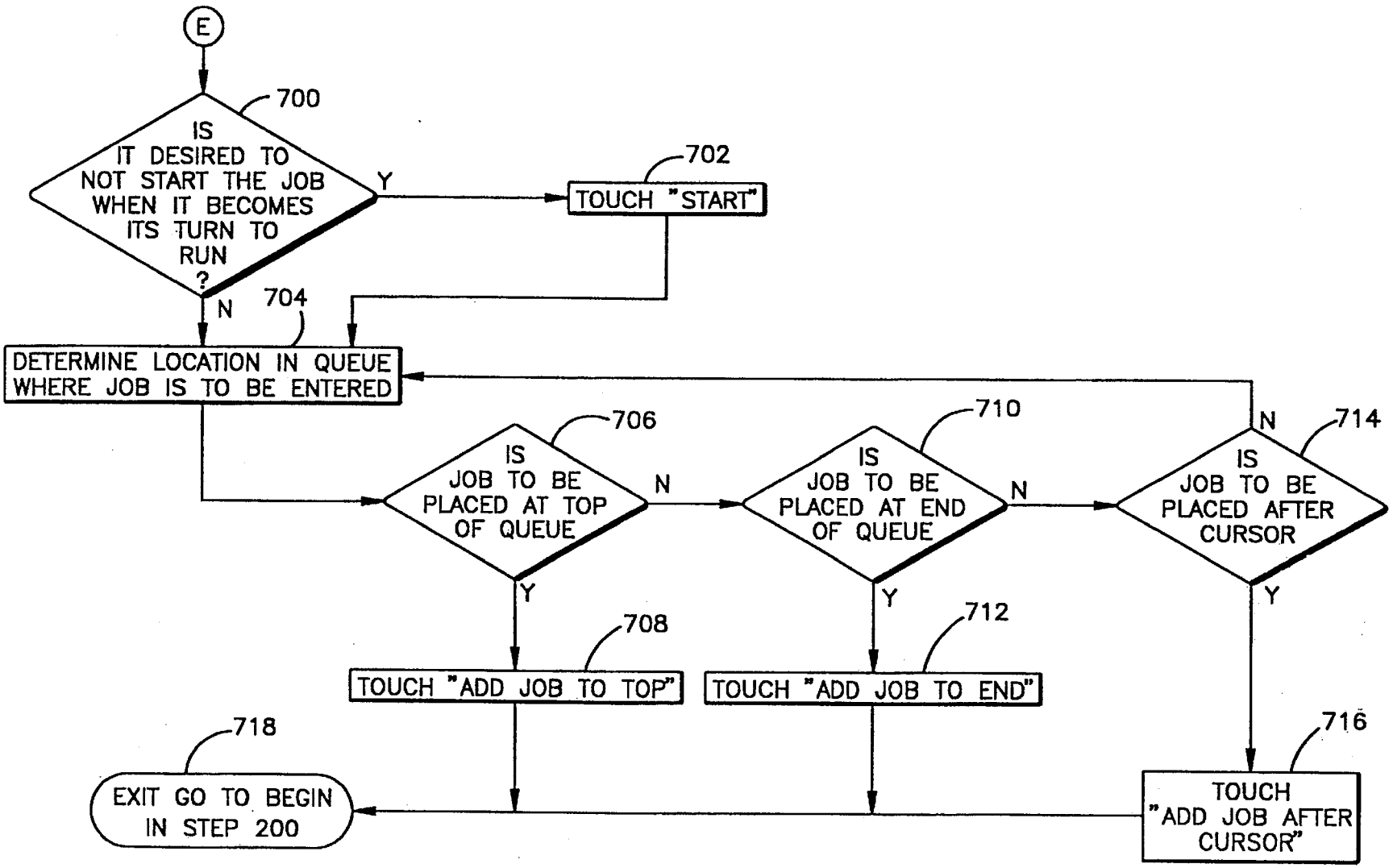

The program then proceeds to step 700 (FIG. 8). In step 700, a determination is made by the operator as to whether it is desired to not start the selected job when it becomes its turn to run. If the determination in step 700 is affirmative, the operator touches a touch responsive area labelled "START", as shown in step 702. The program then proceeds to step 704. If the determination in step 700 is negative, the program proceeds directly to step 704.

In step 704, the operator determines the location in the queue where the selected job is to be entered. The program then proceeds to step 706 in which a determination is made as to whether the selected job is to be placed at the top of the queue. If the determination in step 706 is affirmative, the operator presses a touch responsive area labelled "ADD JOB TO TOP", as shown in step 708. If there is no job currently running, the selected job is placed at the topmost position in the queue. If a job is currently running, the currently running job is interrupted and then breaks at the next logical end of zone mark. After the currently running job breaks, the selected job starts to run. The selected job continues to run until it is completed. After the selected job is completed, the job which was previously interrupted starts to run again beginning at the point where it broke off. This job will continue to run until it is completed. The program then proceeds to step 718 in which the program exits and returns to the beginning in step 200.

If the determination in step 706 is negative, the program proceeds to step 710 in which a determination is made by the operator as to whether the selected job is to be placed at the end of the queue. If the determination in step 710 is affirmative, the operator presses a touch responsive area labelled "ADD JOB TO END", as shown in step 712. The program then proceeds to step 718 in which the program exits and returns to the beginning in step 200.

If the determination in step 710 is negative, the program proceeds to step 714 in which a determination is made by the operator as to whether the selected job is to be placed after the cursor which appears on the touch screen display 36. If the determination in step 714 is negative, the program returns to step 704. If the determination in step 714 is affirmative, the program proceeds to step 716 in which the operator presses a touch responsive area labelled "ADD JOB AFTER CURSOR" appearing on the touch screen display 36. The program then proceeds to step 718 in which the program exits and returns to the beginning in step 200.

As a second example as shown in step 234 (FIG. 3B), assume that two different jobs are selected in which the first job is a tape job and the second job is a newsstand job. In a newsstand job, books are produced according to nonsubscriber newsstand requirements for a particular geographic region. All of the books for the particular geographic region are produced before moving onto the next geographic region.

Figures 5, 6, 7:
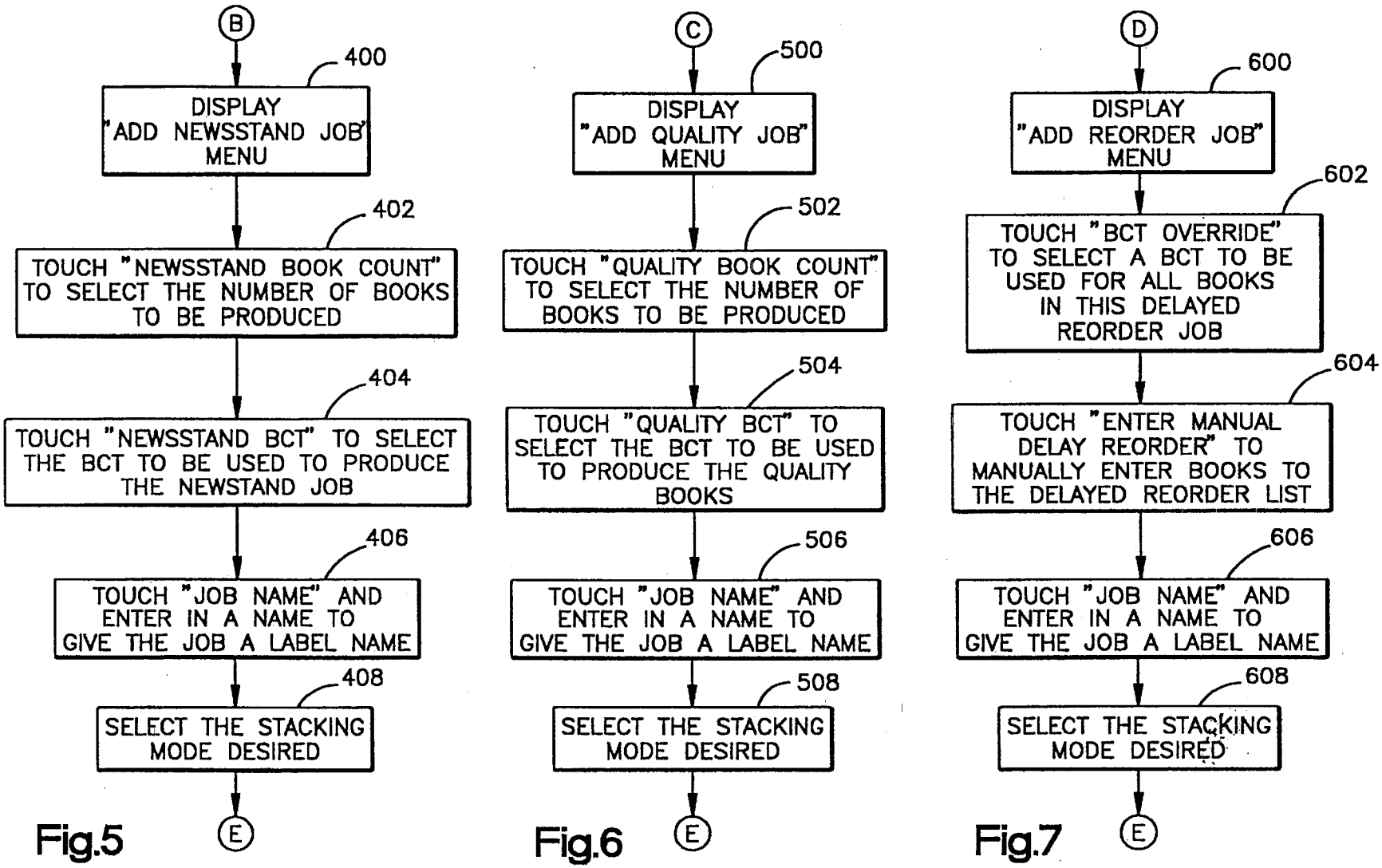

In step 234, a determination is made as to whether a newsstand job is selected. If the determination in step 234 is affirmative, the program proceeds to step 400 (FIG. 5). In step 400, an add newsstand job menu is displayed on the touch screen display 36. In step 402, the operator presses a touch responsive area labelled "NEWSSTAND BOOK COUNT" to select the number of books to be reproduced. The operator then presses the touch responsive area labelled "NEWSSTAND BCT" to select the BCT to be used to produce the newsstand job, as shown in step 404. In step 406, the operator then presses the touch responsive area labelled "JOB NAME" and enters in a name to give the job a label name. In step 408, the operator then selects the stacking mode desired for the selected job. The program then proceeds to step 700 and proceeds from step 700 through step 718 as already described in detail hereinabove.

As a third example as shown in step 236 (FIG. 3B), assume that the first job is a tape job and the second job is a quality job. In step 236, a determination is made as to whether a quality job is selected. In a quality job, books are produced to provide a quality check of the production run. The printer or the publisher uses the books produced in a quality job. The books produced in a quality job may include one or all of the possible subscriber or newsstand book signature combinations produced during a production run. All of the books in a quality job are produced before moving onto the next geographic region.

If the determination in step 236 is affirmative, the program proceeds to step 500 (FIG. 6) in which an add quality job menu is displayed on the touch screen display 36. In step 502, the operator presses a touch responsive area labelled "QUALITY BOOK COUNT" to select the number of books to be produced. In step 504, the operator then presses a touch responsive area labelled "QUALITY BCT" to select the BCT to be used to produce the quality books. The program then proceeds to step 506 in which the operator presses a touch responsive area labelled "JOB NAME" and then enters in a name to give the job a label name. In step 508, the operator selects the stacking mode desired for the selected job. The program then proceeds to step 700 and proceeds from step 700 through step 718 as already described in detail hereinabove.

As a fourth example as shown in step 238 (FIG. 3B), assume that the first job selected is a tape job and the second job selected is a delayed reorder job. In a delayed reorder job, books are produced to replace earlier produced books which were determined to be faulty and in need of replacement. All of the books in a delayed reorder job are produced before moving onto the next geographic region.

In step 238, a determination is made as to whether a delayed reorder job is selected. If the determination in step 238 is affirmative, the program proceeds to step 600 (FIG. 7) in which an add reorder job menu is displayed on the touch screen display 36. In step 602, the operator presses a touch responsive area labelled "BCT OVERRIDE" to select a BCT to be used for all books in the delayed reorder job. In step 604, the operator then presses a touch responsive area labelled "ENTER MANUAL DELAY REORDER" to allow the operator to manually enter books to the delayed reorder list. The program then proceeds to step 606 in which the operator presses a touch responsive area labelled "JOB NAME" and enters in a name to give the job a label name. In step 608, the operator selects the stacking mode desired for the selected job. The program then proceeds to step 700 and proceeds from step 700 through step 718 as already described in detail hereinabove.

It should be apparent from the description of the present invention that the collator 10 produces books in an order according to a job queue which contains a sequence of selected jobs to be run. The operator selects the types of jobs contained in the job queue, the number of jobs contained in the job queue, and the sequence of the jobs contained in the job queue, to control the type and quantity of books to be produced by the collator 10. The jobs are run in order from top of the queue to bottom of the queue without having to stop operation of the collator 10 during a changeover from one job in the job queue to the next job in the job queue. By not having to stop operation of the collator 10 during a changeover from one job to the next job, an advantage results in that valuable production time need not be lost to effect the changeover.

The collator 10 may, for example, sequentially produce books for a geographic region based on a subscriber list, and then produce newsstand, reorder, and quality copy books for that same geographic region without having to stop operation of the collator 10 during a changeover from one job in the job queue to the next job in the job queue. As another example, the collator 10 may produce books for a series of geographic regions including subscriber, newsstand, reorder, and quality copy books without having to stop operation of collator 10 during a changeover from one job in the job queue to the next job in the job queue. Further, the order of the geographic regions may be changed without having to stop operation of the collator 10.

From the above description of the invention, those skilled in the art to which the present invention relates will perceive improvements, changes and modifications. Such improvements, changes and modifications within the skill of the art to which the present invention relates are intended to be covered by the appended claims.

Having described the invention, the following is claimed:

1. A collator for collating a first plurality of books containing at least a first and third signature and a second plurality of books containing at least second and third signature and a third plurality of books containing at least third and one of the first signature and the second signature, said collator comprising:

a first hopper for storing the first signatures having a first characteristic;

a second hopper for storing the second signatures having a second characteristic;

a third hopper for storing the third signatures having a third characteristic;

a plurality of collating pockets movable relative to said hoppers and for receiving signatures from said hoppers;

each of said hoppers having actuatable means for, when actuated, feeding an individual signature from one of said hoppers;

means for storing (i) a first number corresponding to the number of the first plurality of books, (ii) a second number corresponding to the number of said second plurality of books, and (iii) a third number corresponding to the third plurality of books;

means for selecting the order of collation of the books;

means for controlling actuation of said actuatable means to initially feed individual signatures from said hoppers to said plurality of pockets without stopping movement of said pockets relative to said hoppers in accordance with said selected order.

2. A collator according to claim 1 wherein said controlling means includes a computer which communicates with said storing means.

3. A collator according to claim 2 wherein said controlling means includes a first I/O controller associated with said first hopper, a second I/O controller associated with said second hopper, and a communications network which interconnects said computer and said first and second I/O controllers to enable said computer to control feeding of an individual signature from said one of said first and second hoppers.

4. A collator according to claim 1 wherein said storing means includes a storage memory for storing information including information indicative of said first number.

5. A collator according to claim 4 wherein said storage memory stores information indicative of a second number which corresponds to the number of individual signatures to be delivered from said second hopper.

6. The apparatus of claim 1 further comprising means for changing said order of the books to be collated from said hoppers without stopping movement of said pockets relative to said hoppers.

* * * * *